US011280574B2

(12) United States Patent
Langley et al.

(10) Patent No.: US 11,280,574 B2
(45) **Date of Patent: *Mar. 22, 2022**

(54) ARROW REST

(71) Applicant: Bear Archery, Inc., Evansville, IN (US)

(72) Inventors: Timmy Langley, Newburgh, IN (US); Daniel Karcher, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/947,745

(22) Filed: Aug. 14, 2020

(65) Prior Publication Data

US 2020/0370857 A1 Nov. 26, 2020

Related U.S. Application Data

(63) Continuation of application No. 16/594,562, filed on Oct. 7, 2019, now Pat. No. 10,746,500, which is a continuation of application No. 16/030,230, filed on Jul. 9, 2018, now Pat. No. 10,443,968.

(60) Provisional application No. 62/640,078, filed on Mar. 8, 2018, provisional application No. 62/534,934, filed on Jul. 20, 2017.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 124/44.5
See application file for complete search history.

(56) References Cited

U.S. PATENT DOCUMENTS 3,890,951 A * 6/1975 Jennings ..... F41B 5/10 124/44.5
3,919,997 A * 11/1975 Day ..... F41B 5/1438 124/44.5
4,282,850 A * 8/1981 Warnicke ..... F41B 5/143 124/24.1
4,324,221 A * 4/1982 Peck ..... F41B 5/143 124/24.1
4,351,311 A * 9/1982 Phares ..... F41B 5/143 124/44.5
4,372,282 A * 2/1983 Sanders ..... F41B 5/143 124/24.1
4,380,226 A * 4/1983 Saunders ..... F41B 5/143 124/44.5
4,587,945 A * 5/1986 Little ..... F41G 1/467 124/87
4,662,346 A * 5/1987 Laffin ..... F41B 5/143 124/24.1
4,759,337 A * 7/1988 Suski ..... F41B 5/14 124/24.1
4,858,569 A 8/1989 Chang
(Continued)

*Primary Examiner* — Alexander R Niconovich
(74) *Attorney, Agent, or Firm* — Woodard, Emhardt, Henry, Reeves & Wagner, LLP

(57) ABSTRACT

An arrow rest arrangement in a capture style arrow rest for an archery bow. The arrow capture portion may be formed as an inverted brush. The arrow capture portion defines a central aperture through which an arrow shaft extends. The aperture may include two straight slanted lower side portions forming a "V" profile to support the arrow.

20 Claims, 5 Drawing Sheets

(56) References Cited

U.S. PATENT DOCUMENTS 4,858,589 A * 8/1989 Chang ..... F41B 5/143 124/24.1
4,914,072 A 4/1990 Chang
4,917,072 A * 4/1990 Chang ..... F41B 5/143 124/24.1
5,009,215 A * 4/1991 Ludwig ..... F41B 5/143 124/24.1
5,025,773 A * 6/1991 Hintze ..... F41B 5/143 124/24.1
5,042,450 A * 8/1991 Jacobson ..... F41B 5/143 124/44.5
5,253,633 A * 10/1993 Sisko ..... F41B 5/1438 124/24.1
5,456,242 A * 10/1995 Ruholl ..... F41B 5/143 124/24.1
5,460,153 A * 10/1995 Huntt ..... F41B 5/143 124/24.1
5,462,041 A * 10/1995 Solecki ..... F41B 5/143 124/24.1
5,685,287 A * 11/1997 Greywall ..... F41B 5/143 124/44.5
5,896,849 A * 4/1999 Branthwaite ..... F41B 5/143 124/44.5
6,502,566 B1 * 1/2003 Achkar ..... F41B 5/143 124/44.5
RE38,096 E 4/2003 Branthwaite et al.
6,557,541 B2 * 5/2003 Pinto, Jr. ..... F41B 5/143 124/24.1
6,561,175 B1 * 5/2003 Tidmore ..... F41B 5/143 124/44.5
6,725,851 B1 * 4/2004 Graf ..... F41B 5/143 124/44.5
6,742,510 B2 * 6/2004 Troncoso, Jr. ..... F41B 5/143 124/44.5
6,742,511 B1 * 6/2004 Remme ..... F41B 5/143 124/24.1
6,772,747 B1 * 8/2004 Vastag ..... F41B 5/143 124/24.1
6,789,535 B1 * 9/2004 McIntyre ..... F41B 5/143 124/44.5
6,978,775 B2 * 12/2005 Graf ..... F41B 5/143 124/44.5
6,994,080 B1 * 2/2006 Yoder ..... F41B 5/143 124/44.5
7,827,979 B2 * 11/2010 Rager ..... F41B 5/143 124/44.5
7,913,678 B2 * 3/2011 Hudkins ..... F41B 5/143 124/44.5
8,342,161 B2 * 1/2013 Harwath ..... F41B 5/143 124/44.5
8,544,458 B1 * 10/2013 LoRocco ..... F41B 5/143 124/44.5
8,875,687 B1 * 11/2014 Huang ..... F41B 5/143 124/44.5
8,939,137 B2 * 1/2015 Hunt ..... F41B 5/143 124/44.5
8,960,174 B2 2/2015 Khoshncod
8,967,131 B2 3/2015 Hunt
9,243,862 B1 * 1/2016 Webb ..... F41B 5/143
9,459,069 B1 * 10/2016 Campbell ..... F41B 5/143
9,500,434 B1 * 11/2016 LoRocco ..... F41B 5/143
2006/0027222 A1 2/2006 Yoder et al.
2010/0263651 A1 * 10/2010 Evans ..... F41B 5/143 124/44.5
2013/0139798 A1 * 6/2013 Khoshnood ..... F41B 5/143 124/44.5
2013/0139799 A1 * 6/2013 Khoshnood ..... F41B 5/143 124/44.5
2013/0269668 A1 * 10/2013 Hunt ..... F41B 5/143 124/44.5
2014/0083403 A1 * 3/2014 Khoshnood ..... F41B 5/143 124/44.5
2014/0283803 A1 * 9/2014 Maccarrick ..... F41B 3/02 124/20.3

* cited by examiner

ARROW REST

This application is a continuation of U.S. patent application Ser. No. 16/594,562 filed on Oct. 7, 2019. U.S. patent application Ser. No. 16/594,562 is a continuation of U.S. patent application Ser. No. 16/030,230 filed Jul. 9, 2018 now U.S. Pat. No. 10,443,968, which claims the benefit of U.S. Provisional Patent Application No. 62/534,934 filed on Jul. 20, 2017 and U.S. Provisional Patent Application No. 62/640,078 filed on Mar. 8, 2018, all of which are incorporated herein by reference.

FIELD OF THE INVENTION

Aspects of the present invention deal with archery bows, and in particular deal with accessories such as arrow rests usable with archery bows.

BACKGROUND OF THE INVENTION

An archery bow stores energy when an archer draws the bowstring. When the bowstring is released, the stored energy propels the arrow. A compound or a recurve bow each typically has a central riser portion or assembly, with upper and lower limbs extending to limb tips. A bowstring extends between the limb tips and is either connected directly to the limb tips or engages rotatable elements such as pulleys or cams mounted to the limb tips.

Arrow rests can be used with archery bows, including compound or recurve bows, to support and preferably stabilize an arrow shaft in position to allow the shaft to be drawn and released from an archery bow, preferably with the elongate axis of the arrow aligned with the desired flight path and without wobble or deviation from the arrow's axial alignment during the draw and release cycle. Various types of arrow rests are known.

In traditional/classic archery, a shelf on the riser can be used to directly support the arrow shaft during the draw and release process, but the fletchings or vanes can impact the shelf and can cause arrow deviation or damage during the release. In more modern arrangements, an add-on arrow rest accessory is often arranged adjacent the shelf. Certain types of add-on rests are non-moving supports. Others are mechanically operated fall-away rests. Some types of rests incorporate a capture feature which helps prevent the arrow from falling laterally off of the rest during movement of the bow.

Usually add-on rests include a base or bracket which is adhered or clamped to the riser, for example using two horizontal screws which engage threaded holes in the riser wall above yet adjacent to the shelf. The bracket and screw arrangement, and the rest assembly, may include slots, adjustment screws, sliders and clamps, or other features which allow the archer to manually tune the arrow rest to the archer's desired positioning laterally, vertically, forward/backward and/or angled relative to the riser.

A WHISKER BISCUIT® brand capture style arrow rest incorporates a ring shaped bracket with a disc shaped inverted brush with projecting bristles arranged radially around and toward an arrow shaft to capture and support the shaft during loading, draw and release of the arrow. When the arrow is released, the vanes travel through the brush without interference. Some WHISKER BISCUIT® rests incorporate a slot in the side or upper edge of the bracket and brush to allow an arrow shaft to be laterally placed into the rest. Embodiments of the WHISKER BISCUIT® arrow rest are illustrated in U.S. Pat. Nos. 5,896,849; 6,725,851; 6,978,775 and RE38,096.

Other types of capture style arrow rests include a shaped bracket substantially encircling an arrow support position. Portions such as bristles, pins, tabs, flaps or other support pieces extend inward and are configured to radially engage and support an arrow from multiple points around the circumference of the arrow shaft. When the arrow is released, the fletchings or vanes travel through the rest without interference. The bracket may include a slot or opening to allow the arrow shaft to be laterally introduced into the rest. Examples of capture style arrow rests are illustrated in U.S. Pat. Nos. 4,351,311; 4,372,282; 4,858,589; 4,917,072; 5,042,450; 5,253,633; 5,460,153; 6,994,080; 7,827,979, 7,913,678; and 8,967,131.

SUMMARY

Certain embodiments disclosed herein include an arrow rest arrangement in a capture style arrow rest. In one illustrated embodiment, the arrow capture portion is disc shaped and is formed as an inverted brush. The arrow capture portion defines a central aperture through which an arrow shaft extends. The aperture may be asymmetric with two straight, slanted lower side portions forming a "V" profile. The upper portion of the aperture may be rounded or an arcuate curve extending between the upper ends of the side portions. In certain embodiments, the arcuate portion forms at least 180 degrees and may span more degrees. The overall profile of the aperture may be characterized as an inverted teardrop shape with a downward pointing corner or angle.

In another illustrated embodiment, the arrow capture portion is formed of three inward facing brush portions. The arrow capture portion defines a roughly triangular central aperture through which an arrow shaft extends. The aperture may include two slanted lower side portions forming a "V" profile. The upper portion of the aperture may be a third brush portion extending horizontally above the arrow. The overall profile of the aperture may be characterized as a triangle with a downward pointed apex or corner.

When an arrow shaft extends through the aperture, the lower V portion engages and supports the shaft diameter. Advantageously, the side portions are tangential to the shaft and engage the shaft in short contact areas approximating a single point of contact with the shaft. Accordingly, there are only two points of direct contact between the shaft and the arrow capture portion. This reduced contact area reduces friction between the arrow shaft and the rest during the draw and release cycle and reduces wear and tear on the rest. The reduced contact area also minimizes the risk of noise.

In one embodiment, an arrow rest arrangement includes a base adapted to be mounted to an archery bow. A frame portion extends from the base with an arrow capture portion in the frame portion to support an arrow shaft. The arrow capture portion is formed by a plurality of bristles extending inward to define an aperture for the arrow shaft. The aperture has two straight side portions intersecting at a lower point and diverging at an angle to form a "V" profile.

In a further embodiment, an arrow rest arrangement includes an archery bow with upper and lower limbs extending to upper and lower limb tips and with a bowstring extending between the limb tips. An arrow with an arrow shaft defining an axis is perpendicular to the bowstring. An arrow capture portion is mounted to the archery bow to support the arrow shaft, wherein the arrow capture portion is mounted in a plane substantially perpendicular to the axis of the arrow shaft. The arrow capture portion defines an aperture encircling the arrow shaft. The aperture has two straight side portions intersecting at a lower point and diverging at an angle. The two straight side portions are tangential to the arrow shaft and each support the arrow shaft in a contact area approximating a single point of contact.

Other potential advantages include that the V shaped profile may be a single size rest which can be used with arrows of different diameters. The V shaped profile will center the arrow shaft along a vertical plane within the aperture, assisting in a consistent alignment of the arrow shaft with the plane of the bowstring and bow.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Certain embodiments disclosed herein include an arrow rest arrangement in a capture style arrow rest. In one illustrated embodiment, the arrow capture portion is disc shaped and is formed as an inverted brush. The arrow capture portion defines a central aperture through which an arrow shaft extends. The aperture may have two straight slanted lower side portions forming a "V" profile. The upper portion of the aperture may be rounded or an arcuate curve extending between the upper ends of the side portions. In certain embodiments, the arcuate upper portion forms at least 180 degrees and may span more degrees. The overall profile of the aperture may be characterized as an inverted teardrop shape.

In another illustrated embodiment, the arrow capture portion is formed of three inward facing brush portions. The arrow capture portion defines a roughly triangular central aperture through which an arrow shaft extends. The aperture may include two slanted lower side portions forming a "V" profile. The upper portion of the aperture may be a third brush portion extending above the arrow shaft. The overall profile of the aperture may be characterized as a triangle with a downward pointed corner.

When an arrow shaft extends through the aperture, the lower V portion engages and supports the shaft diameter. Advantageously, the side portions are tangential to the shaft and engage the shaft in short contact areas approaching and approximating a single point of contact with the shaft. Accordingly, there are effectively only two points of direct contact between the shaft and the arrow capture portion. This reduced contact area reduces friction between the arrow shaft and the rest during the draw and release cycle and reduces wear and tear on the rest. The reduced contact area also minimizes the risk of noise.

Other potential advantages include that the V shaped profile may be a single size rest which can be used with arrows of different diameters. The V shaped profile will center the arrow shaft along a vertical plane within the aperture, assisting in a consistent alignment of the arrow shaft with the plane of the bowstring and bow.

Figure 1:
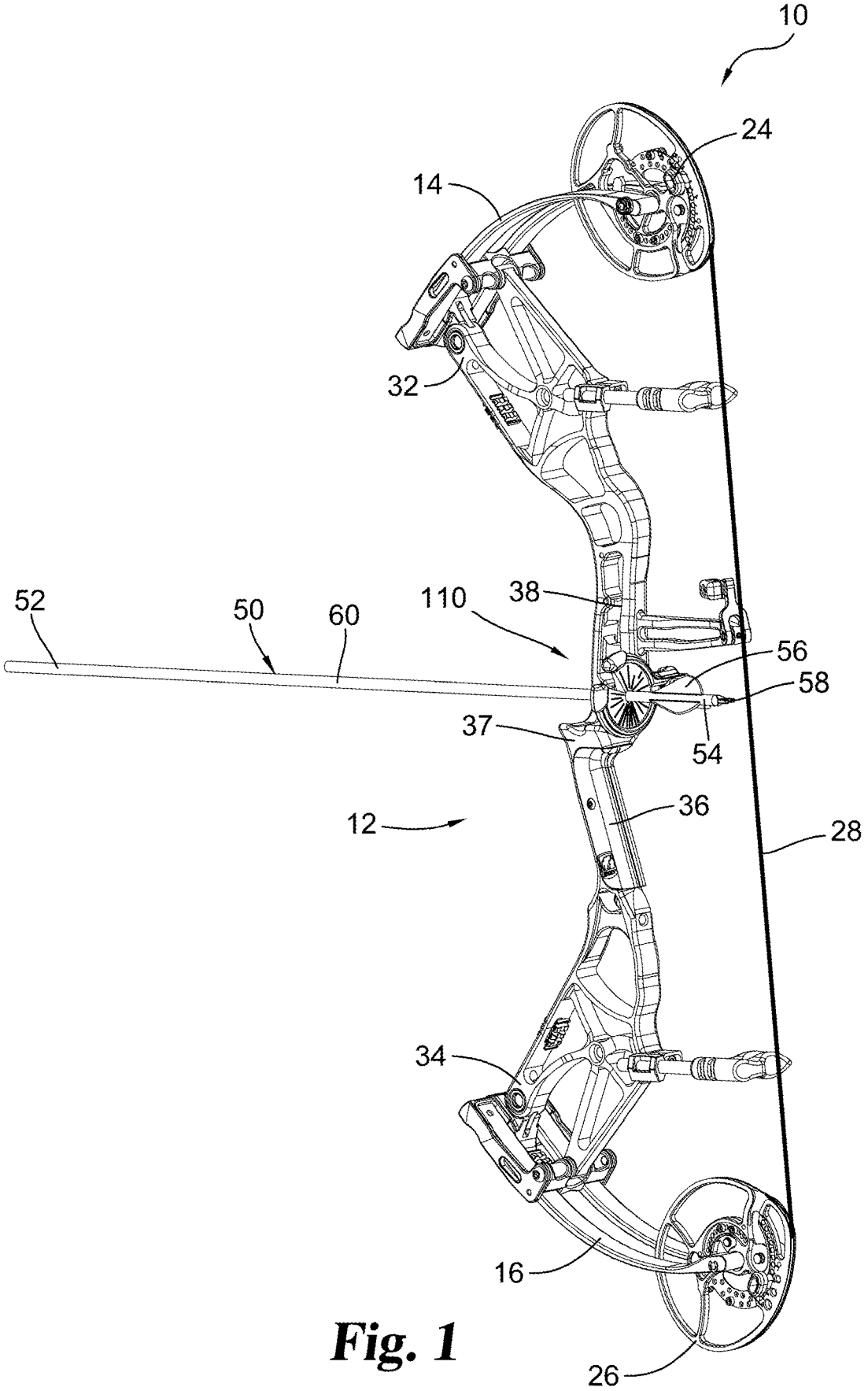
FIG. 1 is a side view of an archery bow in an undrawn position incorporating an embodiment of the present disclosure.

FIG. 1 illustrates an example of a compound archery bow generally designated 10 with an archery arrow 50. Bow 10 and arrow 50 are representative and described for illustration and context and are not intended to be limiting. When viewed from the perspective of an archer holding the bow, it includes a riser assembly 12. Riser assembly 12 includes a riser body having an upper end 32, a lower end 34, a handle 36, a shelf 37 and a sight mounting portion 38. Upper and lower flexible limbs 14 and 16 respectively extend from locations at riser upper end 32 and riser lower end 34. Limbs 14 and 16 may be integral with the riser such as in many recurve bows, or may be separate and mounted, for example using limb pockets. In the example illustrated, rotational members such as upper cam 24 and lower cam 26 are supported at the respective limb tips for rotary movement about respective axles. In the embodiment shown, upper and lower limbs are formed of parallel and symmetric limb portions sometimes called quad limbs. Alternately, a single piece limb can have a notch or slot area removed to allow a rotational element to be mounted to the limb tip. Bowstring 28 extends between the limb tips and can be directly connected to the limb tips in a recurve bow arrangement or can engage tracks on rotational members in a compound bow arrangement.

From the perspective of the archer, the bowstring is considered rearward relative to the riser which defines forward. Upward and downward references are from the perspective of an archer holding a compound or recurve bow vertically, with the bowstring substantially perpendicular to the ground. A bow orientation may not be perpendicular during actual use, for example when hunting from a tree stand. Directional references herein are for ease of explanation and are not intended to be limiting. Similarly, a bow riser held with the left hand is illustrated, but is not intended to be limiting. A symmetric arrangement can be used with a bow having a right-handed riser.

In a compound bow, the portion of the cable which defines the bowstring 28 is fed out from cams 24 and 26 when the bow is drawn, causing the limbs to bend and energy to be stored. Compound bows often include additional cables such an anchor cable or power-cable which are not shown for ease of illustration. When the bowstring 28 is released with arrow 50 engaged to the bowstring, the limbs 14 and 16 return to their rest position, causing cams 24 and 26 to rotate in the opposite direction, to take up the bowstring 28 and launch arrow 50 with an amount of energy proportional to the stored energy. It should be appreciated that a bow riser, limbs and cams can take on various designs in accordance with the many different types of bows. The present invention can be used with dual-cam compound bows, or can be used with single-cam bows as described for example in U.S. Pat. No. 5,368,006 to McPherson. It can also be used with hybrid cam bows or recurve bows. The present invention can also be used in other types of bows, which are considered conventional for purposes of the present invention.

Figure 2:
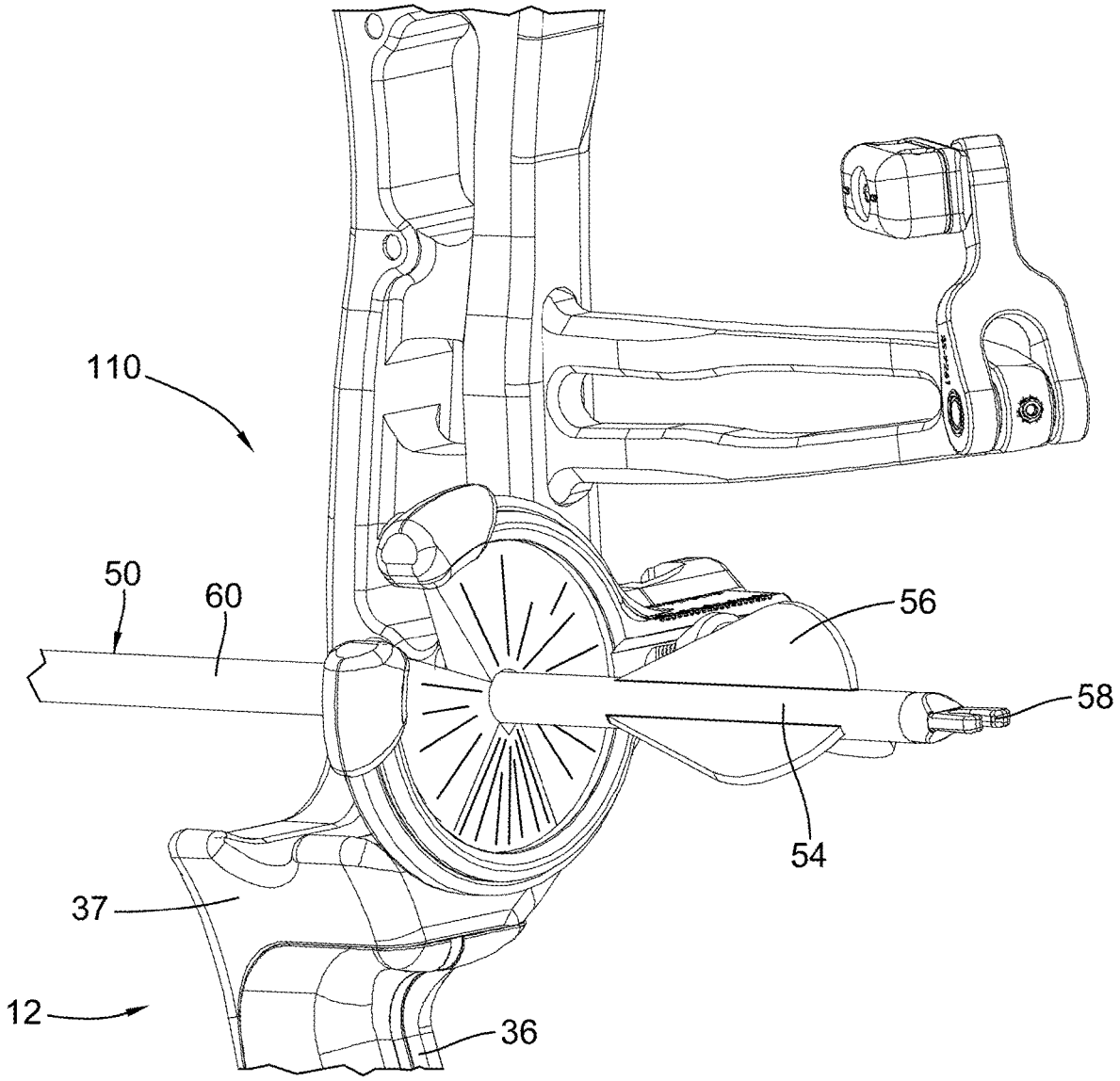
FIG. 2 is an enlarged partial view of the embodiment shown in FIG. 1.
Figure 3:
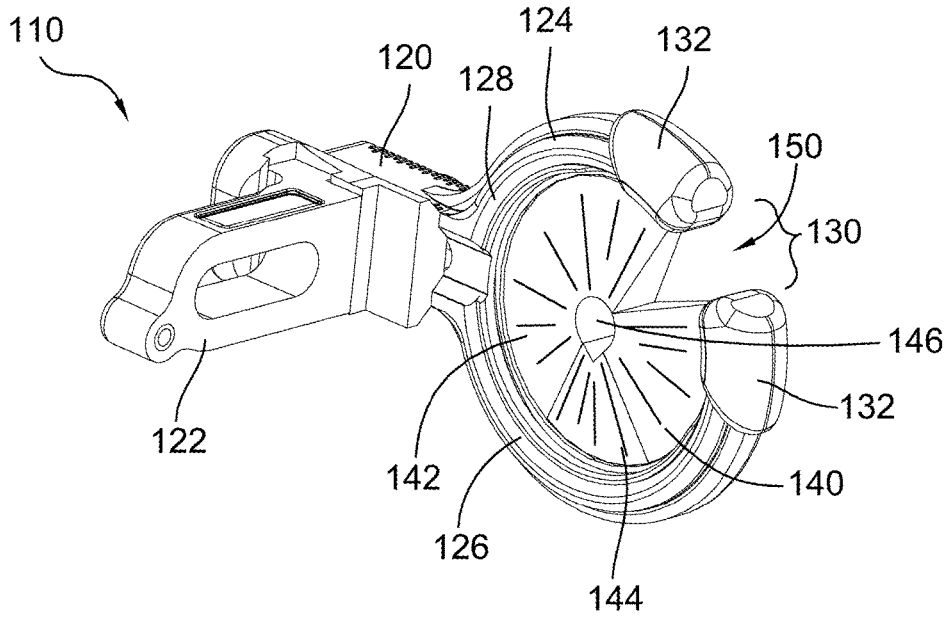
FIG. 3 is a perspective view of an arrow rest usable in the embodiment shown in FIG. 1.
Figure 4:
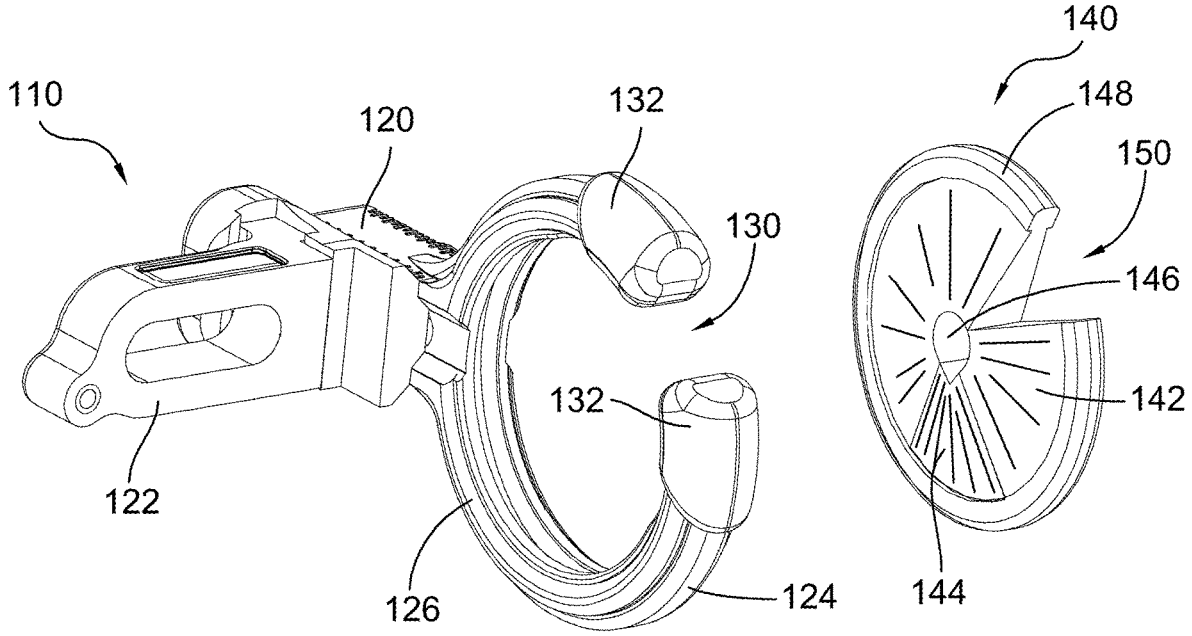
FIG. 4 is a perspective exploded view of the embodiment shown in FIG. 3.
Figure 5:
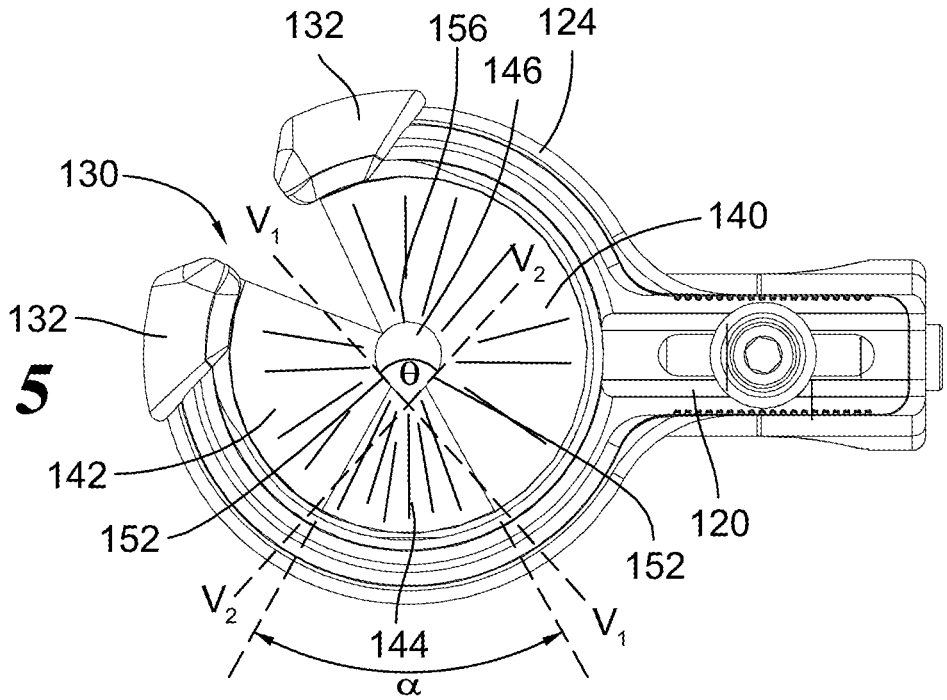
FIG. 5 is a rear view of the arrow rest embodiment shown in FIG. 3.

A representative arrow 50 including a shaft 60, a forward end 52 to which an arrowhead can be mounted, a rear end 54, fletchings or vanes 56 and a nock 58 is shown for illustration in FIGS. 1-2. Ideally arrow 50 is perpendicular to bowstring 28. Commonly, an arrow includes three vanes or fletchings spaced at 120 degree intervals. Variants include two or four vanes or fletchings, usually equally spaced apart. Typically, the nock 58 engages bowstring 28 during the draw and release cycle of bow 10. The orientation of nock 58 maintains the arrow shaft in a specific orientation to the bow, namely perpendicular to the bowstring. In a typical orientation, one vane 56 extends upward and two other vanes are spaced 120 degrees apart and diverge in downward directions. Optional archery bow accessories can be mounted on or used with bow 10 as desired by a specific archer.

A typical vertical riser in a compound bow is formed from or as a piece of rectangular bar stock with a cross-section. The upper and lower portions 32 and 34 of the riser are preferably aligned along a central axis. Correspondingly, the axes of limbs 14 and 16 are ideally aligned with the riser central axis and ideally the bowstring tracks of the cams 24, 26 and bowstring 28 are aligned in a central plane containing the cam tracks, bowstring and the central axes of both the limbs and the riser. Although manufactured differently, most recurve bows have an area with a substantially rectangular cross-section near the handle. In a recurve bow, ideally a comparable central axis and plane is defined by the bowstring, limbs and riser.

When considered from the perspective of an archer holding the bow 10, the riser includes a handle 36 located in the middle height portion of the bow, typically in the center or slightly below the center height of the riser. Optionally, handle 36 may include mounted grip portions such as cushions or pads for size and comfort.

The riser defines a shelf 37 arranged adjacent to and slightly above handle 36. A length of the riser defining sight mounting portion 38 extends upward above shelf 37. The height of the sight mounting portion 38 defines where an add-on arrow rest is normally mounted to the riser and also where a sight accessory can be mounted. The sight mounting portion 38 is often laterally offset from the central axis of the riser along its height and returns to the central axis at a lower end via shelf 37. The sight mounting portion 38 is often defined by forming bends in the rectangular stock at the upper and lower ends of the offset portion. The sight mounting portion can be described as generally having a "C" or sideways shallow "U" shaped profile. The sight mounting portion may be on the left or right side depending on a left or righted handed bow orientation. Alternately, in shoot-through bow arrangements, the sight mounting portion 38 extends vertically upward on both sides of a central shelf portion to define a mounting opening for a rest and sight and then converges to the central axis at an upper height. In typical bows, sight mounting portion 38 has sufficient height above shelf 37 to allow both an arrow rest accessory and a sight accessory to be mounted and appropriately spaced above shelf 37.

An embodiment of arrow rest 110 is illustrated on bow 10 in FIGS. 1-2, and in further detail in FIGS. 3-6. Arrow rest 110 includes a base 120 including a bracket portion 122. Bracket portion 122 may be used to secure arrow rest 110 to bow 10, for example using two screws or bolts which engage the riser adjacent sight mounting portion 38. Arrow rest 110 is typically arranged to position the arrow rest above handle 36 and below a sight accessory position on sight mounting portion 38. Arrow rest 110 receives and captures the shaft 60 of arrow 50. Arrow shaft 60 slides along an axis and through arrow rest 110 during the draw and release cycle. The capture function helps prevent the arrow shaft from moving laterally or vertically during movement or rotation of the bow. Fletchings or vanes 56 are oriented to pass through arrow rest 110 without interference upon release.

Arrow rest base 120 extends via transition section 128 to a frame portion 124 which typically extends in a plane substantially perpendicular to the axis of arrow 50. Frame portion 124 may be substantially circular in shape extending from transition portion 128. An arrow capture portion 140 is mounted in frame portion 124. Optionally, frame portion 124 can be partially disassembled by removing screws to allow the removal of a mounting ring 126. Removal of mounting ring 126 allows an arrow capture portion 140 to be removed and/or replaced. When assembled, mounting ring and frame portion 124 apply a clamping force to secure arrow capture portion 140. Other arrow capture portion mounting arrangements may also be used. Optionally, frame portion 124 defines a radial slot or gap 130, with a corresponding aligned radial slot or gap 150 defined in arrow capture portion 140. Gap 130 and gap 150 are sized to allow the diameter of arrow shaft 60 to be laterally introduced into arrow rest 110. Optional covers 132 may partial enclose and protect the ends of frame portion 124 adjacent to gap 130.

Arrow capture portion 140 may be a capture style arrow rest. In the illustrated embodiment in FIGS. 3-6, arrow capture portion 140 is disc shaped and is formed as an inverted brush. In a representative example, the inverted brush is formed by a plurality of inward extending bristles extending inward from frame 148 to define aperture 146. In some embodiments, arrow capture portion 140 incorporates a single style of bristles. In this embodiment, the bristles may form a substantially continuous brush to encircle the arrow shaft.

In alternate embodiments, two sets of bristles may be used, for example including a first set of bristles 142 extending around a majority of the arrow shaft circumference, and a second set of bristles 144 arranged within an arcuate angle $\alpha$, generally below arrow shaft 60. In certain arrangements, the second set of bristles 144 is arranged primarily below the arrow shaft and forms the supporting contact points while the first set of bristles primarily prevents the arrow shaft from falling laterally off of the rest during movement of the bow. In some embodiments, angle $\alpha$ is equal to or less than 120 degrees. In certain embodiments, angle $\alpha$ is between approximately 55 and approximately 75 degrees. In specific example embodiments, angle $\alpha$ is approximately 58 degrees or approximately 70 degrees. The second set of bristles 144 may have a different resistance or stiffness than the first set of bristles 142, for example by having a different size or diameter, being arranged in a different density, being made of a different material and/or having a different cross-sectional shape. The resistance or stiffness of second set of bristles 144 may be higher than the resistance or stiffness of first set of bristles 142. The increased resistance of second set of bristles 144 may help support the weight of the arrow shaft and also may increase the lifespan of the arrow capture portion by providing greater durability to minimize deformation, wear or damage to the bristles due to wear and tear. In some embodiments, second set of bristles 144 is a different color than first set of bristles 142.

Arrow capture portion 140 may include slot 150 and may be resilient to allow introduction of an arrow shaft through first set of bristles 142, yet in selected embodiments the perimeter of aperture 146 can be characterized as substantially closed. The term "closed" means that the perimeter formed by aperture 146 is generally continuous after the arrow shaft 60 is located in the aperture. For instance, the perimeter of aperture 146 has no clearly visible openings or only small openings significantly less than the diameter of an arrow. Accordingly, it inhibits an arrow shaft 60 from laterally or vertically escaping aperture 146 by ordinary movement or rotation of bow 10. The closed perimeter may be resilient and may allow an arrow shaft to be laterally introduced to aperture 146 via gap 130 and gap 150.

In alternate embodiments, arrow capture portion 140 may be a capture style arrow rest formed with a single lower support or multiple supports, such as two, three, or four supports, which are spaced around the circumference of the arrow shaft. Examples supports are pins, tabs, cushions or truncated pie-piece shaped flaps. Flap portions may be made of resilient or pliable sheet portions made of plastic, vinyl, leather or similar materials. When pins, tabs, cushions or flaps are used, they can be arranged and may function in substantially the same manner as first set of bristles 142 and second set of bristles 144. When the supports are not made of bristles the supports may need to be spaced or have openings to allow the fletchings or vanes of an arrow to pass between the supports without interference when a properly oriented arrow is released. For example, three supports can be spaced around the shaft, with a pair of offset supports having straight sections supporting the arrow shaft.

Figure 6:
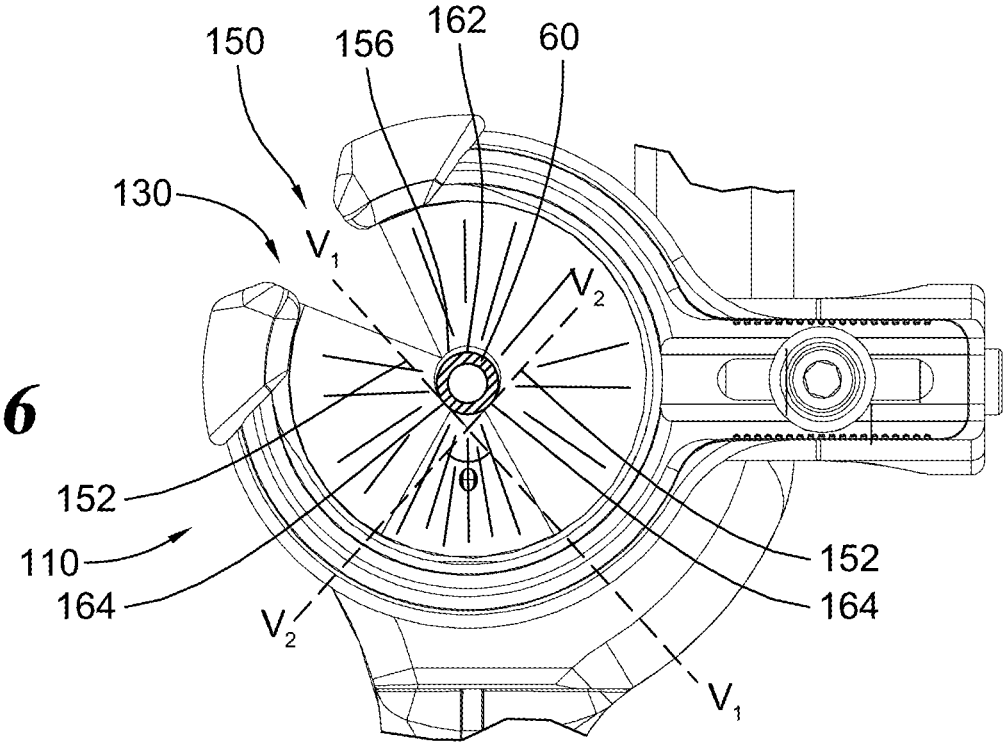
FIG. 6 is an enlarged rear view of the embodiment shown in FIG. 5 including a cross-section of an arrow shaft.

Arrow capture portion 140 defines a central aperture 146 through which arrow shaft 60 extends, a cross-section of shaft 60 is illustrated within aperture 146 in FIG. 6. In the illustrated embodiment, aperture 146 is asymmetric with two slanted lower side portions 152 forming a "V" profile. The two side portions 152 of aperture 146 are each straight with straight edges which intersect at a lower point and diverge by an angle θ. An example angle is 60 degrees. The side portions 152 correspondingly define axes $V_1$ and $V_2$ forming the V profile. The upper portion 156 of aperture 146 may be rounded or an arcuate curve extending between the upper ends of side portions 152. In certain embodiments, the arcuate portion forms at least 180 degrees and may span more degrees. The overall profile of aperture 146 may be characterized as an inverted teardrop shape.

As shown in FIG. 6, in use an arrow shaft 60 extends through aperture 146 during the draw and release cycle of bow 10. Aperture 146 is sized slightly larger than the diameter of shaft 60. When shaft 60 extends through aperture 146, the lower V portion engages and supports the shaft diameter. Advantageously, the side portions 152 are tangential to shaft 60 and engage shaft 60 in contact areas as two short tangential sections 164, each approaching or approximating a single tangent point engagement to shaft 60. Accordingly, there are effectively only two points of direct contact between shaft 60 and arrow capture portion 140. This reduced contact area reduces friction between the arrow shaft and rest 110 during the draw and release cycle and reduces wear and tear on the rest. The reduced contact area also minimizes the risk of noise that might alert a game animal as the shaft is drawn through the arrow capture portion 140. In certain embodiments the side portions 152 support the weight of the arrow shaft within the rest from tangential points that are approximately 120 degrees apart and are equally offset from a vertical axis through the shaft. An open space or gap may be present between a lowest point of the arrow shaft and the point where the two side portions intersect.

In certain embodiments, arrow 50 has at least one upward extending vertical vane 56 oriented to pass through the arrow capture portion without interference upon release. In addition, arrow 50 may have two vanes are spaced 120 degrees apart and diverging in downward directions. The two downward diverging vanes may be approximately perpendicular to the straight edges of side portions 152 and are oriented to pass through the respective side portions without interference upon release. For instance, when the arrow capture portion is formed of bristles, the vane extending vertically upward is oriented to pass through a subset of the bristles forming an upper brush portion above the arrow shaft without interference upon release. Similarly, two downward diverging vanes are oriented to pass through two subsets of bristles forming two side brush portions without interference upon release.

Figure 7:
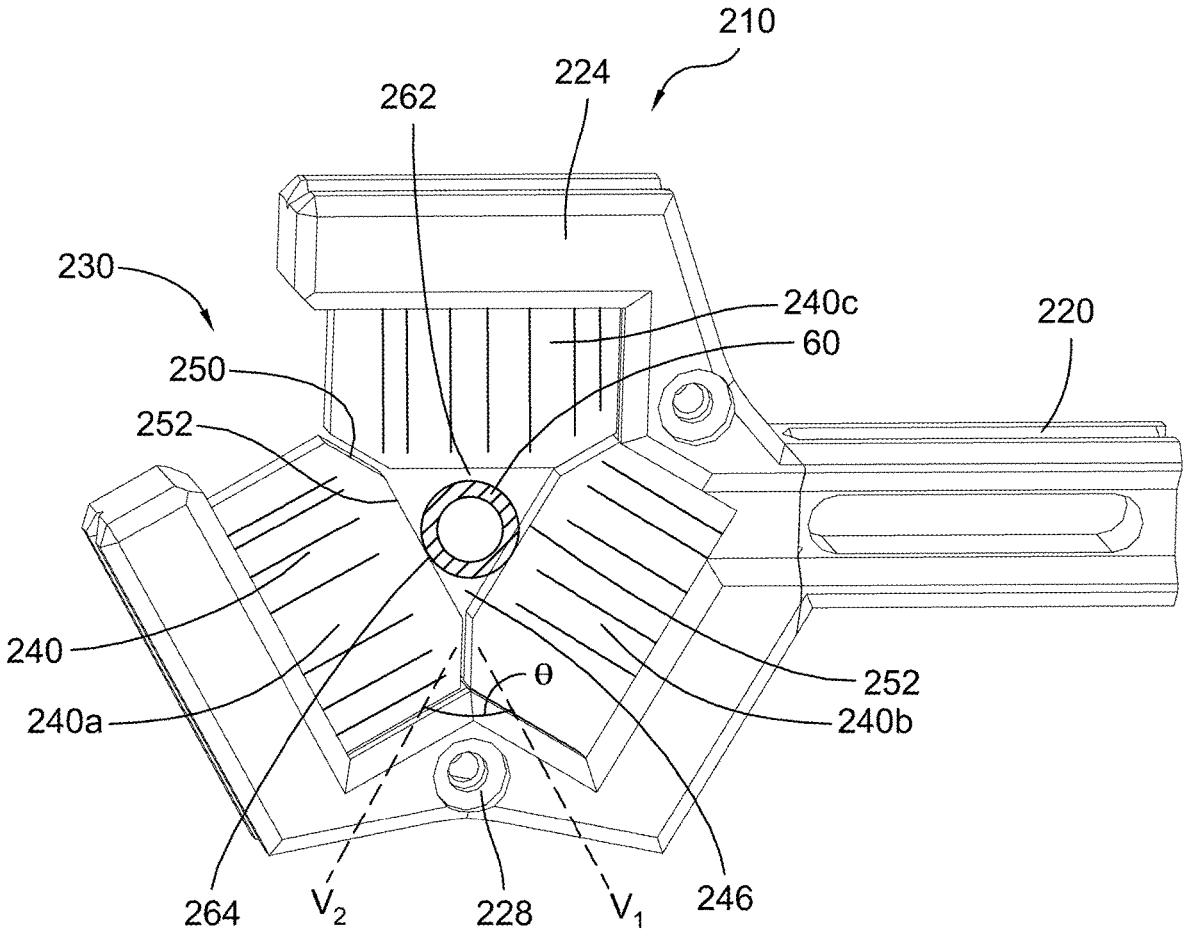
FIG. 7 is an enlarged rear view of an alternate embodiment including a cross-section of an arrow shaft.

As an alternate embodiment, arrow rest 210 is illustrated in FIG. 7. Arrow rest 210 can be mounted and used on bow 10 and used with arrow 50 in essentially the same manner as arrow rest 110. Arrow rest 210 includes a base 220 which can mounted to bow 10 using a bracket such as bracket portion 122 shown in FIG. 3.

Arrow rest base 220 extends to a frame portion 224 which typically extends in a plane substantially perpendicular to the axis of arrow 50. In this embodiment, frame portion 224 is roughly hexagonal in shape. In some embodiments, certain of the hexagon sides may each be formed of two shorter, angled side portions. An arrow capture portion 240 is mounted in frame portion 224. In this embodiment, arrow capture portion 240 is formed using three brush portions 240*a*, 240*b* and 240*c*. The brush portions may be three separate brushes, each brush having a frame piece with bristles extending inward from the frame piece. Optionally, frame portion 224 can be partially disassembled by removing screws 228 to allow the removal and replacement of the brush portions. Optionally, frame portion 224 defines a radial gap 230 with a corresponding aligned gap 250 defined in arrow capture portion 240. In the illustrated embodiment, gap 230 is formed as an open side of frame portion 224. Gap 230 and gap 250 allow the diameter of arrow shaft 60 to be laterally introduced into arrow rest 210.

In a representative example, arrow capture portion 240 is formed by a plurality of inward extending bristles. In some embodiments, arrow capture portion 240 incorporates a single style of bristles. In alternate embodiments, two sets of bristles may be used, for example including a first set of bristles extending around a majority of the arrow shaft circumference, and a second set bristles arranged generally below arrow shaft 60. The second set of bristles may have a different resistance or stiffness than the first set of bristles.

In the illustrated embodiment, arrow capture portion 240 is formed of three brush portions 240*a*, 240*b* and 240*c*. Each brush portion includes an inward facing straight side or edge portion 252 facing the arrow shaft. This forms two straight lower side portions and a straight upper portion. The brush portion corners may be truncated to allow close spacing. The edge portions 252 define central aperture 246 through which arrow shaft 60 extends. A cross-section of shaft 60 is illustrated within aperture 246 in FIG. 7. Aperture 246 is defined in part by the inward edges 252 of two lower brush portions 240*a* and 240*b* arranged at a diverging angle θ forming a "V" profile. The lower edge portions 252 correspondingly define axes $V_1$ and $V_2$ forming the V profile. The upper portion of aperture 246 may be formed by the edge portion 252 of the third brush portion 240*c*. Advantageously, the lower edge portions 252 are tangential to shaft 60 and engage shaft 60 in contact areas as short tangential sections 264 approaching or approximating a single tangent point engagement to shaft 60. The overall profile of aperture 246 may be characterized as triangular in shape with one downward pointing corner or apex.

While arrow capture portion 240 includes slot 250 to allow introduction of an arrow shaft, in selected embodiments the perimeter of aperture 246 is substantially closed. The term "closed perimeter" means that the perimeter of aperture 246 formed by arrow capture portion 240 is generally continuous around the arrow shaft after the arrow shaft 60 is located in the aperture. The closed perimeter may include small gaps or spaces, such as spaces between adjacent brushes or between bristles, which are significantly smaller in size than the diameter of the arrow. Accordingly, it inhibits an arrow shaft 60 from laterally or vertically escaping arrow rest 210 during movement or rotation of bow 10. The closed perimeter may be resilient and may allow an arrow shaft to be laterally introduced to aperture 246 via gap 230 and gap 250.

The outer diameter of various arrows may vary by weight and manufacturer. Modern carbon filament hunting arrow sizes often have an outer diameter in a range between approximately 0.2 inches and approximately 0.4 inches, and commonly approximately 0.3 inches or less. In other offerings, the arrows have an outer diameter between 4.0 and 6.5 mm. Arrows for target shooting may have larger diameters. For example, target events following the rules set by World Archery allow arrow outer diameter up to 9.3 mm or the National Field Archery Association allows arrow diameters up to 10.7 mm. Aluminum or wooden arrows may also have larger diameters.

An advantage of the V shaped profile is that a single size rest can be used with arrows of different diameters. The V shaped profile will center arrow shaft 60 along a vertical plane within aperture 146 or 246, assisting in a consistent alignment of the arrow shaft with the plane of the bowstring and bow. By defining a diverging V shaped profile, the straight side portions 152 or 252 can be used with arrow shafts of different diameters while still engaging each size of arrow shaft in two tangential points or sections 164 or 264 and while centering the arrow shaft within aperture 146 or 246.

In certain embodiments, a widest separation between the diverging upper ends of side portions 152 is approximately 0.3 inches or alternately approximately 6.5 mm. In another embodiment, the separation is approximately 0.325 inches. In yet another embodiment, the separation is approximately 0.360 inches. The radius of arcuate portion 156 can be approximately half or slightly larger than half of the widest separation distance of the side portions 152. Other suitable dimensions can be used as will be understood by those of skill in the art.

In some arrow sizes, the arrow shaft 60 may only contact the V shaped profile at points formed by first set of bristles 142. In other arrow sizes, the arrow shaft 60 may only contact the V shaped profile at points formed by second set of bristles 144. In certain arrow sizes, the shaft may contact the V shaped profile at a transition point between first set of bristles 142 and second set of bristles 144.

Upper portion 156 or upper brush portion 240*c* may be sized and/or shaped to be slightly spaced away from arrow shaft 60, forming a gap 162 or 262. When arrow 60 is properly seated, upper portion 156 or upper brush portion 240*c* may not contact the arrow shaft. However, upper portion 156 or upper brush portion 240*c* still perform a capture function by helping to hold arrow 50 within arrow rest 110 or 210 and by inhibiting undesired lateral and vertical movement.

While the invention has been illustrated and described in detail in the drawings and foregoing description, the same is to be considered as illustrative and not restrictive in character, it being understood that only the preferred embodiments have been shown and described and that all changes and modifications that come with the spirit of the invention are desired to be protected.

What is claimed is:

1. An arrow rest arrangement, comprising:

a frame portion adapted to be mounted to an archery bow;

an arrow capture portion in the frame portion to support an arrow shaft, the arrow capture portion being formed by a plurality of bristles extending inward to define an aperture for the arrow shaft;

wherein the aperture has two straight side portions intersecting at a lower point and diverging at an acute angle to form a "V" profile with a downward pointing apex wherein the two straight side portions are arranged so that two downward diverging vanes of an arrow pass through the bristles of the straight side portions upon release.

2. The arrow rest arrangement of claim 1, wherein the downward pointing apex is in a vertical plane centered on the arrow shaft.

3. The arrow rest arrangement of claim 1, wherein the two side portions are arranged to be tangential to an arrow shaft arranged through the aperture, wherein the side portions each engage and support the arrow shaft at a single point of contact.

4. The arrow rest arrangement of claim 3, wherein the side portions are arranged to center arrows along a central vertical plane within the aperture.

5. The arrow rest arrangement of claim 3, wherein the side portions are arranged to center arrows along a vertical plane centered between the single points of contact of the two side portions.

6. The arrow rest arrangement of claim 1, wherein the aperture has an arcuate upper portion.

7. The arrow rest arrangement of claim 6, wherein the arcuate upper portion spans approximately 180 degrees.

8. The arrow rest arrangement of claim 1, wherein the aperture has a straight upper portion extending horizontally above the arrow.

9. An arrow rest arrangement, comprising:

an archery bow with upper and lower limbs extending to upper and lower limb tips and with a bowstring extending between the limb tips;

an arrow with an arrow shaft defining an axis perpendicular to the bowstring;

an arrow capture portion mounted to the archery bow to support the arrow shaft, wherein the arrow capture portion is mounted in a plane substantially perpendicular to the axis of the arrow shaft, the arrow capture portion define an aperture encircling the arrow shaft;

wherein the aperture includes two sets of bristles forming two straight side portions intersecting at a lower point and diverging at an acute angle, wherein the lower point at which the two side portions intersect is in a vertical plane centered on the arrow shaft and wherein the two straight side portions are tangential to the arrow shaft and each support the arrow shaft at a single point of contact;

wherein the two sets of bristles are arranged so that two downward diverging vanes of the arrow pass through the bristles of the two straight side portions upon release.

10. The arrow rest arrangement of claim 9, wherein the aperture comprises a third set of bristles above the arrow shaft.

11. The arrow rest arrangement of claim 10, wherein the third set of bristles is arcuately shaped.

12. The arrow rest arrangement of claim 10, wherein the third set of bristles form a straight upper portion extending horizontally above the arrow.

13. The arrow rest arrangement of claim 9, wherein the two straight side portions support the arrow shaft at contact points approximately 120 degrees apart.

14. An arrow rest arrangement, comprising:

a frame portion adapted to be mounted to an archery bow;

an arrow capture portion arranged in the frame portion to support an arrow shaft, the arrow capture portion defining an aperture encircling the arrow shaft; and wherein the profile of the aperture defines an inverted teardrop shape with a closed continuous perimeter defined by two straight edges which intersect at a lower point and define a downward pointing corner, the profile further defined by an arcuate upper portion extending between upper ends of the straight edges.

15. The arrow rest arrangement of claim 14, wherein the straight edges intersect at an angle of approximately 60 degrees.

16. The arrow rest arrangement of claim 14, wherein the arrow capture portion includes two sets of bristles forming the two straight edges.

17. The arrow rest arrangement of claim 14, wherein there are only two points of direct contact between the arrow shaft and the arrow capture portion when the arrow shaft is supported by the two straight edges.

18. The arrow rest arrangement of claim 17, where the two points of direct contact are spaced approximately 120 degrees apart around the arrow shaft.

19. The arrow rest arrangement of claim 14, wherein the two straight edges are arranged to center arrows along a central vertical plane within the aperture.

20. The arrow rest arrangement of claim 19, wherein a single size of the two straight edges will center arrows with shaft diameters in a range between 4.0 mm and 10.7 mm.

* * * * *